United States Patent [19]

Kofler

[11] Patent Number: 4,697,756

[45] Date of Patent: Oct. 6, 1987

[54] WINDING MACHINE FOR WINDING AND/OR UNWINDING WEB-LIKE GUIDED MATERIALS

[75] Inventor: Wilhelm Kofler, Uzwil, Switzerland

[73] Assignee: Benninger AG, Uzwil, Switzerland

[21] Appl. No.: 774,004

[22] Filed: Sep. 9, 1985

[30] Foreign Application Priority Data

Sep. 11, 1984 [CH] Switzerland ..... 4321/84

[51] Int. Cl.[4] ..... B65H 18/04; B65H 18/10; B65H 54/553

[52] U.S. Cl. ..... 242/67.1 R; 242/68.4; 242/129.6

[58] Field of Search ..... 242/67.1 R, 68.4, 58.6, 242/55.2, 79, 129.6, 129.62

[56] References Cited

U.S. PATENT DOCUMENTS

| | | | |
|---|---|---|---|
| 862,109 | 7/1907 | Roth | 242/68.4 |
| 2,499,562 | 3/1950 | Behrens | 242/58.6 |
| 2,714,996 | 8/1955 | Stroehman | 242/58.6 |
| 4,209,140 | 6/1980 | Seibert | 242/58.6 X |
| 4,483,493 | 11/1984 | Schönmeier | 242/68.4 X |

FOREIGN PATENT DOCUMENTS

| | | | |
|---|---|---|---|
| 1535168 | 7/1969 | Fed. Rep. of Germany . | |
| 3012207 | 10/1980 | Fed. Rep. of Germany | 242/67.1 R |
| 3213203 | 10/1983 | Fed. Rep. of Germany . | |

*Primary Examiner*—Stuart S. Levy
*Assistant Examiner*—Joseph J. Hail, III
*Attorney, Agent, or Firm*—Werner W. Kleeman

[57] ABSTRACT

To simplify and accelerate the chucking of a journal-free beam or roll mandrel in a winding machine and also to automate and accelerate the alignment of the winding machine and the journal-free beam or roll mandrel in relation to a creel middle plane or centerline, a displacement device is connected to an auxiliary side stand by at least one first extension link or hollow spindle and is also connected with a displaceable support by at least one second extension link or solid spindle. To achieve these effects, the first and second extension links or spindles are moved or positively controlled in opposite displacement directions through respectively equal distances relative to a spatially fixed plane passing through the displacement device and which plane extends transverse to the direction of displacement of the winding machine.

15 Claims, 5 Drawing Figures

WINDING MACHINE FOR WINDING AND/OR UNWINDING WEB-LIKE GUIDED MATERIALS

CROSS-REFERENCE TO RELATED APPLICATION

This application is related to my commonly assigned, co-pending U.S. patent application, Ser, No. 06/769,435, filed on Aug. 26, 1985 and entitled "WINDING MACHINE FOR WINDING AND/OR UNWINDING WEB-LIKE GUIDED MATERIALS", the disclosure of which is incorporated herein by reference.

BACKGROUND OF THE INVENTION

The present invention broadly relates to winding machines and, more specifically, pertains to a new and improved construction of a winding machine for winding and unwinding a web-like guided material and having a clamping or chucking arrangement for a beam or roll mandrel.

Generally speaking, the winding machine for winding and/or unwinding a web-like guided material comprises a drive side stand or lateral drive frame carrying a driven first beam or roll mandrel take-up or chucking device, an auxiliary side stand or frame, and a longitudinally displaceable support or bearing block arranged between the side stands or frames and carrying a second beam or roll mandrel take-up or chucking device. The winding machine is equipped with a rolling device comprising rollers or roller means which enable the winding machine to move in a direction transverse to the direction of winding and which rollers or roller means are fixed to the driving side stand or lateral drive frame and the auxiliary side stand or frame. The winding machine is also equipped with a displacement device positioned between the auxiliary side stand or frame and the displaceable support or bearing block.

In other words, the winding machine of the present invention for winding and unwinding a web-like guided material comprises a driven first beam chucking device, a rotatable second beam chucking device, a lateral drive frame for carrying the driven first beam chucking device, an auxiliary side frame and a longitudinally displaceable support situated between the lateral drive frame and the auxiliary side frame for carrying the second beam chucking device. The winding machine has a predetermined direction of winding. The winding machine also comprises a rolling device comprising first and second roller means and enabling the winding machine to move in a direction transverse to the predetermined direction of winding. The first roller means are fixed to the lateral drive frame and the second roller means are fixed to the auxiliary side frame. A displacement device is arranged between the auxiliary side frame and the displaceable support and defines or governs the direction of displacement of the winding machine.

Winding machines of this type are used, for example, as beam warping machines. On beam warping machines, warping beams are prepared by winding-up warp sheets onto a beam or roll mandrel.

When the beams or mandrels are clamped or chucked and unclamped or unchucked, there arise difficulties insofar as the position of the winding machine or of the beam or roll mandrel, or both, is thereby altered in the horizontal direction. The beam or roll mandrel moves slightly out of the axis or line of alignment with the warp sheet and, for example after being clamped or chucked, must be laterally realigned in the longitudinal direction, together with the winding machine, in relation to the warp sheet to be wound. If the fully wound beam or roll mandrel, upon being unclamped or unchucked, is lowered to the floor, then it cannot be exactly determined in advance which points of the floor will be touched by the side discs or plates of the wound beam or roll mandrel because the sliding out or disengagement of the beam or roll mandrel from the beam or roll mandrel take-up or chucking devices is random and the winding machine, because of its travel rollers or roller means on the side stands or frames, can deviate more to one or the other side, i.e. laterally, than is desirable.

SUMMARY OF THE INVENTION

Therefore, with the foregoing in mind, it is a primary object of the present invention to provide a new and improved construction of a winding machine for winding and/or unwinding a web-like guided material which does not exhibit the aforementioned drawbacks and shortcomings of the prior art constructions.

Another and more specific object of the present invention aims at providing a new and improved construction of a winding machine for winding and/or unwinding a web-like guided material in which the beam or roll mandrel remains in a desired laterally aligned or horizontal position when it is being clamped or chucked, as well as when it is being unclamped or unchucked, without special means for securing the beam or roll mandrel being required.

Another important object of the present invention is to provide a winding machine of the previously-mentioned type in which the clamping or chucking and unclamping or unchucking of the beam or mandrel is as easy and fast as possible.

Yet a further significant object of the present invention aims at providing a new and improved construction of a winding machine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the winding machine of the present invention is manifested by the features that the displacement device is connected with the auxiliary side stand or frame by at least one first extension link or hollow spindle and is also connected with the displaceable support by at least one second extension link or solid spindle. As a result, the first and second extension links or spindles are positively moved in opposite directions each by equal amounts relative to a spatially fixed plane passing through the displacement device in a direction extending transverse to the direction of displacement of the winding machine. As a result, the driven first beam chucking device and the rotatable second beam chucking device are simultaneously displaceable in opposite directions by substantially equal amounts relative to the spatially fixed plane passing through the displacement device.

In other words, the winding machine of the present invention is manifested by the features that the displacement device comprises at least one first extension link connected with the auxiliary side frame and at least one second extension link connected with the displaceable support, the first and second extension links being positively moveable in opposite directions each by equal amounts relative to a spatially fixed plane passing through the displacement drive transverse to the direction of displacement of the winding machine.

Accordingly, when the beam or roll mandrel is clamped or chucked, the two beam or roll mandrel take-up or chucking devices of the winding machine are advanced towards or approach the beam or roll mandrel from both sides simultaneously. When the beam or roll mandrel is unclamped or unchucked, then the same beam or roll mandrel take-up or chucking devices are retracted or moved away from both sides of the beam or roll mandrel simultaneously. The position of the beam or roll mandrel in the horizontal direction is determined by the position of the spatially fixed plane passing through the displacement device and which plane extends transverse to the direction of displacement of the winding machine. On being unclamped or unchucked, the middle or center of the beam or roll mandrel is kept at an essentially constant distance or spacing from the aforementioned spatially fixed plane independently of the length of the beam or roll mandrel. When a beam or roll mandrel is being clamped or chucked or when it is being lifted from the floor, it is only necessary to bring the beam or roll mandrel middle or center to the aforementioned essentially constant distance or spacing from the spatially fixed plane to ensure that the beam or roll mandrel middle or center will also retain its position when being clamped or chucked. Furthermore, it is not even necessary, when clamping or chucking, to locate the beam or roll mandrel middle or center exactly at the essentially constant distance or spacing from the aforementioned spatially fixed plane because, during the clamping or chucking process, this essentially constant distance or spacing is positively produced.

Accordingly, the present invention offers the great advantage in a beam warping machine that every beam or roll mandrel within the design limits of the winding machine, no matter how long or short, always remains with its beam or roll mandrel middle or center aligned with the middle or center of the creel which delivers the warp sheet.

The aforementioned extension links or spindles can be formed in various ways. For instance, four equally long beams or bars can be combined into an articulated parallelogram linkage by means of hinges, in which parallelogram linkage one corner point is connected with the auxiliary side stand or frame and the opposite corner point is connected with the displaceable support or bearing block. The two remaining corner points then lie in the spatially fixed plane which extends transversely to the machine direction of displacement. This occurs when the first two corner points of the parallelogram linkage lie parallel to such direction of displacement. When paired, each two teams or bars of the parallelogram linkage conjointly form an extension link. Displacement occurs by alteration of the geometry of the parallelogram linkage, for instance by a spindle possessing a left-hand and a right-hand thread.

It is advantageous if the displacement lines or axes of the extension links or spindles lie in the rotational or winding axis of the winding machine or parallel to such rotational or winding axis of the winding machine. In the latter case, it is further advantageous if they pass through a center of stress or resultant point or centroid which results from the friction reaction forces of the displaceable support or bearing block and the beam or roll mandrel clamping or chucking force.

If this displaceable support or bearing block can be displaced in a particularly friction-free manner, then, for example, it is sufficient to arrange the displacement lines or axes of the extension links or spindles coincident with the rotational or winding axis of the winding machine. This also has structural advantages.

According to a further embodiment of the invention, the displacement device can be aligned or adjusted in relation to a spatially fixed floor reference point. The above-mentioned spatially fixed plane can, but need not, also pass through the spatially fixed floor reference point. The displacement device can, for example, be connected with the spatially fixed floor reference point by means of a column or upright. This spatially fixed floor reference point then determines the position of the respective beam or roll mandrel middle or center. Since, in beam warping machines, the beam or roll mandrel middle or center is, for example, aligned with the creel center, the spatially fixed floor reference point or points can also be pre-aligned with the creel.

Furthermore, as mentioned above the beams or bars may be used as extension links under certain conditions. According to a further embodiment of the invention, the extension links may be formed as extension or jack spindles. It is then advantageous if the extension or jack spindles possess threads of equal pitch. The simultaneous and symmetrical movement of the extension or jack spindles is then particularly easily achieved if one extension link or extension or jack spindle possesses a left-hand thread and the other extension link or spindle a right-hand thread.

According to a further embodiment of the invention, the extension links or spindles are fixedly connected with each other. The first extension link or spindle has a male or external thread which engages a female or internal thread of the auxiliary side stand or frame and the other extension link or spindle has a male or external thread which engages with a female or internal thread of opposite hand or pitch of the displaceable support or bearing block. The displacement device possesses a rotating device or actuator for the extension links or spindles and one of the extension links or spindles, such as the second extension link connected with the support, may be fixed against rotation. In this case, it is the rotating device or actuator which remains at a spatially fixed floor reference point or, respectively, at the spatially fixed plane mentioned above.

The rotating device or actuator advantageously consists of a worm wheel or gear which is fixedly connected with one of the extension links or spindles and which engages a worm or worm pinion. The worm of the rotating device or actuator can be driven manually or can be power-driven and is reversible from left to right hand drive. Such a construction assures easy manipulation, and at the same time, safe clamping or chucking of the beam or roll mandrel.

In accordance with a further embodiment of the invention, the first extension link or spindle is constructed as a hollow externally threaded spindle which engages with a female or internal thread of the auxiliary side stand or frame or, as the case may be, of the displaceable support or bearing block and possesses the rotating device or actuator, whereas the second extension link or spindle is constructed as an externally threaded non-rotatable solid spindle which is fixedly connected with the displaceable support or bearing block, or else, as the case may be, with the auxiliary side stand or frame. The second extension link or non-rotatable solid spindle engages in a female or internal thread situated in the interior of the first extension link or hollow spindle. The displacement device is then particularly compact and the extension links or spindles can project particularly far outwards as they are arranged telescopically. The rotating device advantageously comprises the aforementioned worm wheel which is fixedly connected with the first extension link or hollow spindle, and which engages with the aforementioned worm. As already explained, the worm of the rotating device or actuator can be manually operated or power-driven and can be reversed from left to right hand drive.

If a combination of worm and worm wheel is used as the rotating device or actuator, then it is advantageous for this combination to be mounted in a housing or gearbox which is connected to a spatially fixed floor reference point by means of a torque arm or support. Therefore, the alignment of the rotating device or actuator, respectively of its housing, with the spatially fixed floor reference point is effected by the preferably provided torque arm or support of the worm and worm wheel drive combination.

In accordance with a further embodiment of the invention, two or more spatially fixed floor reference points are established and prepared for selective connection of the displacement device or worm drive means, e.g. by means of a selectively insertable torque arm or support.

This has two decisive advantages. Firstly, it is possible to fix in advance a number of travel planes or travel paths, of the web or web-like material instead of just one, and secondly, it prevents the winding machine from being extended too much to one or the other side if a different or alternate spatially fixed floor reference point is also chosen for connection of the displacement device after exchanging the displacement device for one containing longer or shorter extension links or spindles.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
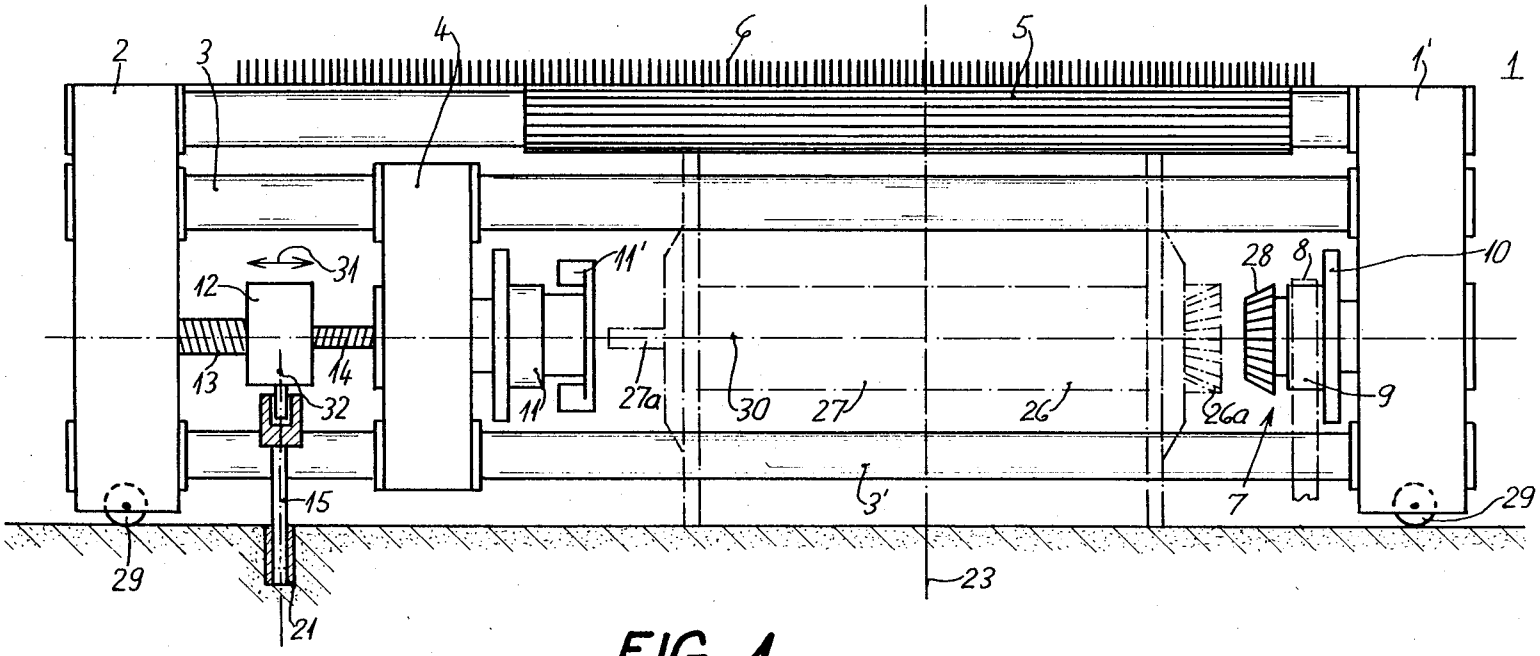
FIG. 1 shows a front view of the inventive winding machine constructed as a beam warping machine.
Figure 4:
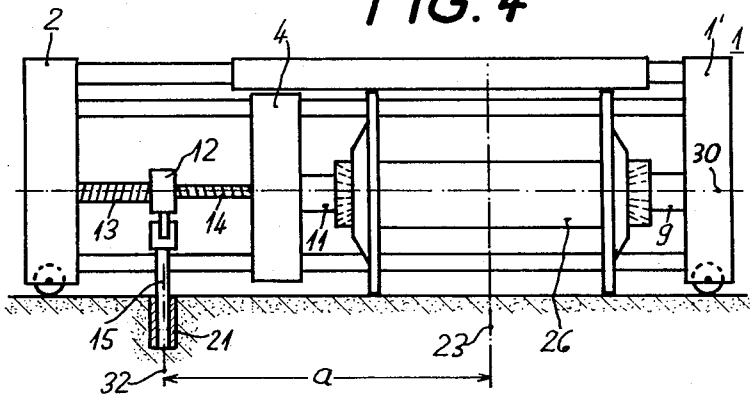
FIG. 4 shows the winding machine of FIG. 1 after the clamping or chucking of a journal-free beam or roll mandrel.
Figure 3:
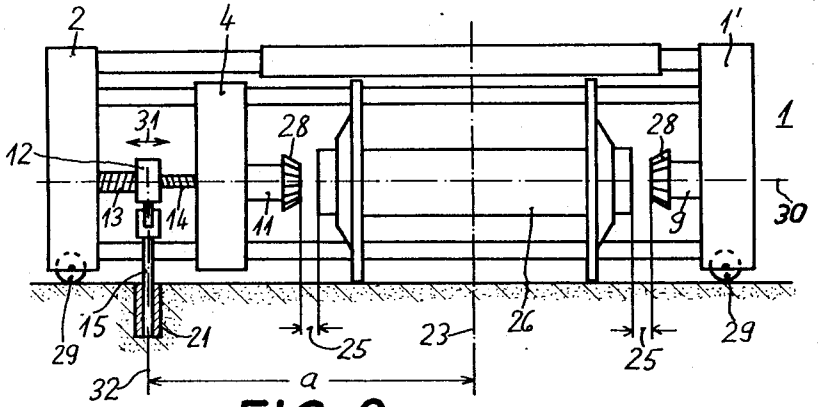
FIG. 3 shows the winding machine of FIG. 1 before the clamping or chucking of a journal-free beam or roll mandrel.

Describing now the drawings, it is to be understood that to simplify the showing thereof, only enough of the structure of the winding machine for winding and/or unwinding a web-like guided material has been illustrated therein as is needed to enable one skilled in the art to readily understand the underlying principles and concepts of this invention. Turning now specifically to FIGS. 1, 3 and 4 of the drawings, the machine depicted by way of example and not limitation therein will be seen to comprise a winding machine designated in its entirety with the reference numeral 1 and constructed as a beam warping machine. The winding machine 1 possesses a drive side stand or lateral drive frame 1' forming a headstock and an auxiliary side stand or frame 2 which are connected with each other by means of guide bars or tie bars 3 and 3'. The side stands or frames 1' and 2 carry a measuring or speed-monitoring deflection roll 5 for deflecting a not particularly shown warp sheet and serving for measuring the travelling speed or velocity of such warp sheet which will be subsequently wound on, for instance, a journal-free warping beam or roll mandrel 26. These side stands or frames 1' and 2 also carry a warp comb 6 which guides the individual threads forming the warp sheet.

The driving side stand or frame 1' possesses a driven first beam or roll mandrel take-up or chucking device designated in its totality with the reference numeral 7. The beam or roll mandrel take-up or chucking device 7 possesses a driving plate or drive disc 9 which is connected with a brake disc or drum 10. The driving plate or drive disc 9 is driven by any suitable and therefore not particularly shown drive unit by means of a belt 8.

A displaceable support or bearing block 4 forming a tailstock is mounted on the guide bars or tie bars 3 and 3' and is displaceable along these guide bars or tie bars 3 and 3'. This displaceable support or bearing block 4 carries a rotatable second beam or roll mandrel take-up or chucking device 11.

In accordance with FIG. 1, the winding machine 1 can be changed over as desired for the selective take-up or chucking of journal-free beams or roll mandrels 26 or journaled beams or roll mandrels 27 provided with journals or stub shafts **27*a***. (A typical beam or roll mandrel is depicted in position with dot-dashed lines.)

For the take-up or chucking of the journal-free beams or roll mandrels 26, the first beam or roll mandrel take-up or chucking device 7 can be provided with a clamping or chucking cone or taper shaft 28 which fits a mating take-up or chucking cone or taper socket **26*a* of the journal-free beam or roll mandrel 26. For the take-up or chucking of the journaled beam or roll mandrel 27, the second beam or roll mandrel take-up or chucking device 11 (as also the first beam or roll mandrel take-up or chucking device 7) can, for example, be optionally provided with a journaled beam or roll mandrel mounting or chuck 11' which can receive the journal or stub shaft 27*a* of the journaled beam or roll mandrel 27 and which is connected with the brake disc or drum 10** by means of indexing or engagement pins or similar facilities.

The driving or drive side stand or lateral drive frame 1' and the auxiliary side stand or frame 2 are equipped with displacement or travel rollers or roller means 29.

A displacement device 12 is arranged between the auxiliary side stand 2 and the displaceable support or bearing block 4. The displacement device 12 is connected, by means of a first extension link or hollow spindle 13, with the auxiliary side stand 2 and by means of a second extension link or solid spindle 14 with the displaceable support 4. The extension links or spindles 13 and 14 are positively controlled in opposite displacement directions, designated by a double-headed arrow 31, and are moveable through respectively equal distances or displacements relative to a spatially fixed plane 32 passing through the displacement device or drive 12 transversely to the direction of displacement 31.

The displacement lines or axes along which the extension links or spindles 13 and 14 are displaceable substantially coincide with the rotational or winding axis 30 of the winding machine 1. The displacement device 12 can be aligned with a spatially fixed floor reference point which is here represented by a sleeve 21 inserted or embedded into the floor. The displacement device 12 can be connected with the sleeve 21 defining the spatially fixed floor reference point by means of a column or upright 15 serving as a torque arm or torque control support.

Figure 2:
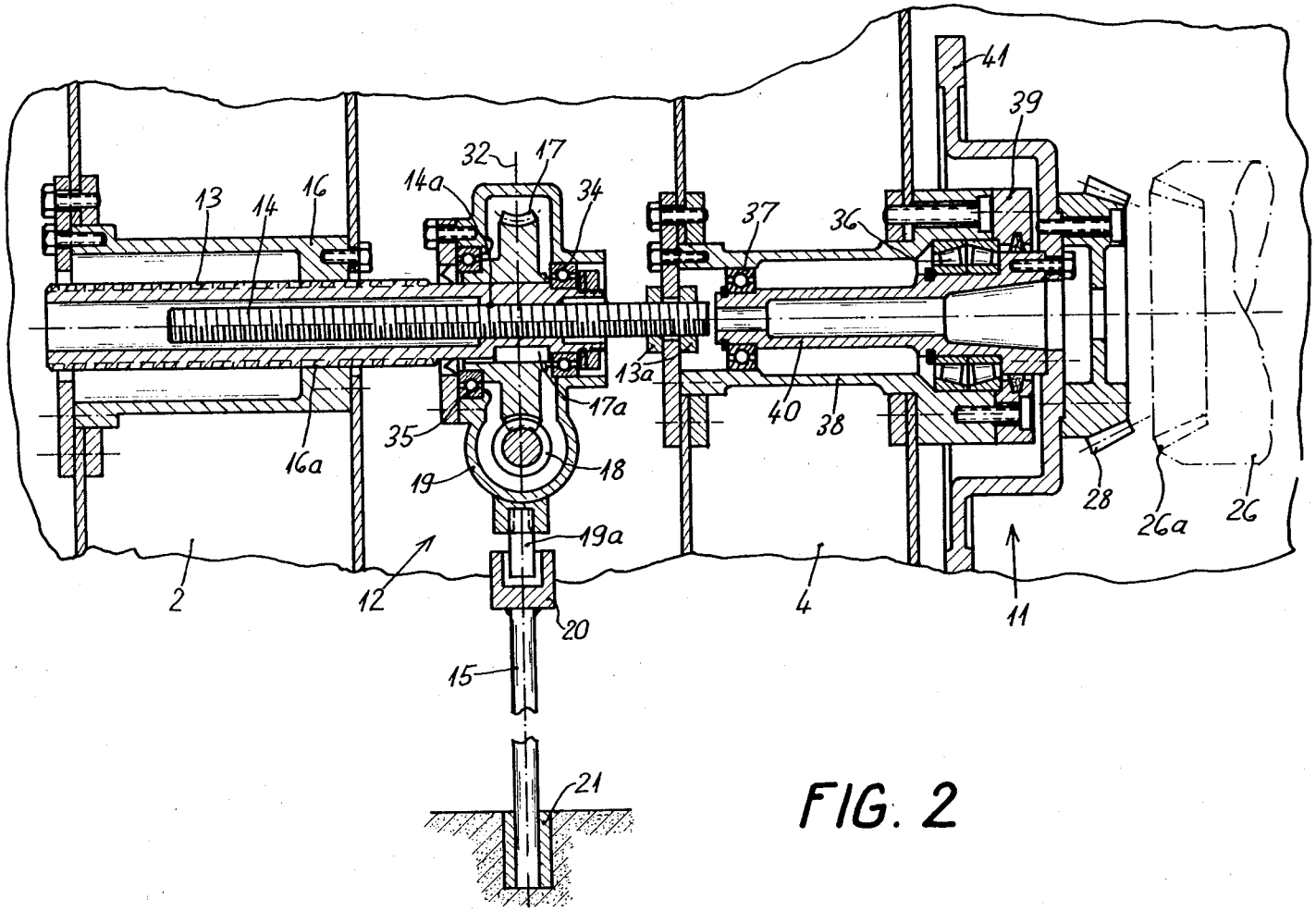
FIG. 2 shows a section through the displacement device of the winding machine of FIG. 1.

Further particulars of the displacement device 12 are shown in FIG. 2, where it can be recognized that the first extension link 13 is constructed as a hollow spindle with a not particularly referenced external thread which engages in a female or internal thread 16*a* of the auxiliary side stand 2. This female or internal thread 16*a* is located inside a threaded bush 16 which is fixed to the wall of the auxiliary side stand 2 by means of bolts or the like. At the right-hand end of the first extension link or hollow spindle 13, there is carried a rotating device or actuator in the form of a worm wheel or gear 17 fixedly connected with the first extension link or hollow spindle 13.

The second extension link 14 is constructed as a non-rotating solid spindle and is fixedly connected with a wall of the displaceable support 4 by means of lock nuts 13*a*. The non-rotating solid spindle, respectively the second extension link 14, engages with a female or internal thread 14*a* which is situated inside the first extension link or hollow spindle 13. Although both first and second extension links or spindles 13 and 14 have different outside diameters, their respective threads have the same pitch. The first extension link or hollow spindle 13 is provided with a left-hand thread, while the second extension link or solid spindle 14 is provided with a right-hand thread.

From FIG. 2 it can be seen that the first extension link or hollow spindle 13 carries a housing 19 of the displacement device 12. For this purpose, anti-friction bearings 34 and 35 serve to support the housing 19 on the first extension link or hollow spindle 13, respectively on a shoulder of the worm wheel 17. The worm wheel 17 is fixedly connected with the first extension link or hollow spindle 13 by means of a key 17*a*. A worm or worm pinion 18 is mounted in the housing 19, which worm 18 engages with the worm wheel 17. The worm 18 is reversibly driven in left or right-hand drive directions by a not particularly shown motive drive means. Alternatively, the worm 18 can also be manually turned, for which purpose there is provided an engageable crank or winch which is not particularly shown. The combination of the worm 18 and the worm wheel 17, which are mounted in the housing 19, is connected to the spatially fixed floor reference point or sleeve 21 by means of the column or upright 15 which here also serves as a torque arm or torque control support for the housing 19.

From FIG. 2 there can be seen that the column or upright 15 carries, at its top, a socket 20 into which is inserted a gudgeon pin or torque pin 19*a* which is fixed to the housing 19. By means of the gudgeon or torque pin 19*a*, the socket 20 secures the housing 19, so that the column or upright 15 is effective as a torque arm or torque control support for the displacement device 12.

From FIG. 2 there can also be seen that the second beam or roll mandrel take-up or chucking device 11 is mounted on the displaceable support 4 with the aid of two anti-friction bearings 36 and 37. The anti-friction bearings 36 and 37 are seated in a carrying tube 38 which forms a tailstock housing and is connected with the displaceable support 4. The carrying tube 38 is connected with the walls of the displaceable support 4 by means of bolts or the like. A cover 39, connected with the carrying tube 38 by means of bolts or the like, is supported against the outer ring or race of the front anti-friction bearing 36. The two anti-friction bearings 36 and 37 carry a hollow shaft or spindle 40 to which a brake disc or drum 41 is rigidly bolted. To the brake disc or drum 41 there can optionally be fixed the journal beam or roll mandrel mounting or chuck 11' as shown in FIG. 1 or the take-up or chucking cone or taper shaft 28 shown in FIG. 2. The take-up or chucking cone or taper shaft 28 fits the mating take-up or chucking cone or taper socket 26*a* of the journal-free beam or roll mandrel 26.

FIG. 3 shows the journal-free beam or roll mandrel 26, before clamping or chucking into the winding machine 1, constructed as a warping beam. Not particularly referenced lateral discs or side plates of the journal-free beam or roll mandrel 26 rest upon the floor. The beam or roll mandrel middle or center lies in a spatially fixed plane 23 which passes through the middle of a not particularly shown creel which is intended to deliver the warp sheet to be wound-up. The plane 32 passes through the displacement device 12 and plane 23 maintains a predetermined distance or spacing a from the plane 32 which is parallel to it. The column or upright 15 is inserted into the sleeve 21 and connected with the displacement device 12, for instance by the gudgeon or torque pin 19*a*. Consequently, the complete winding machine 1 is also aligned with the plane 23, so that distances or spacings 25 of the journal-free beam or roll mandrel 26 from the take-up or chucking cones or taper shafts 28 are at least approximately the same. The rotational or winding axis 30 of the winding machine 1 lies a few millimeters higher than the longitudinal axis of the journal-free beam or roll mandrel 26.

For clamping or chucking the journal-free beam or roll mandrel 26, the worm 18 shown in FIG. 2 is now rotated so that the first extension link or hollow spindle 13 rotates and threads out the second extension link or solid spindle 14. The first extension link or hollow spindle 13, at the same time, displaces the female or internal thread 16*a* of the threaded bush 16 fixed to the auxiliary side stand 2 such that the distances or spacings between the plane 32 and the displaceable support 4 and between the plane 32 and the auxiliary side stand 2 increase by respectively equal amounts. From the position shown in FIG. 3, the complete winding machine 1 moves since its rolling device, i.e. the displacement rollers or roller means 29, rolls to the left along the floor or on not particularly shown guide rails while the displaceable support 4 moves away from the plane 32 by the same amount to the right. During the clamping or chucking operation, the mating or chucking cones or taper sockets 26*a* of the journal-free beam or roll mandrel 26 move upward onto the take-up or chucking cones or taper shafts 28 by a few millimeters until eventually the journal-free beam or roll mandrel 26 is clamped tight or chucked. This condition is shown in FIG. 4.

Without any particular aligning work and without having to carry out any further inspection, the journal-free beam or roll mandrel 26 is now clamped or chucked such that its middle or center lies, as required, in the plane 23, even if it was previously not quite exactly aligned while it was still standing on the floor.

Figure 5:
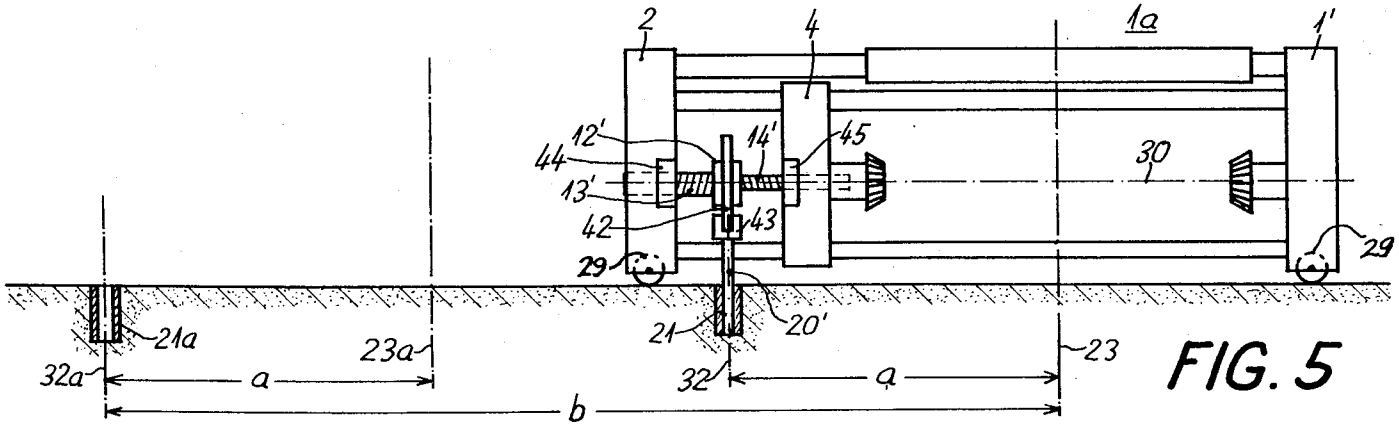
FIG. 5 shows the winding machine depicted in FIG. 1 here provided with a different embodiment or displacement device.

The winding machine la depicted in FIG. 5 is essentially constructed the same as the winding machine 1 shown in FIGS. 1, 3 and 4. However, the displacement device 12' is constructed differently. The first and second extension links 13' and 14' are constructed as spindles. Both the first and second extension links or spindles 13' and 14' possess threads of the same pitch. The first extension link is a hollow spindle 13' having a left-handed thread, whilst the second extension link is a solid spindle 14' having a right-handed thread. Both the first and second extension links or spindles 13' and 14' are fixedly connected with each other through a handwheel 42. This handwheel 42 engages in a fork or slot 43 of a support or upright 20' which is inserted into the sleeve or insert 21. Here too, the sleeve 21 serves as a spatially fixed floor reference point. The first extension link or hollow spindle 13' engages with a female or internal thread 44 of the auxiliary side stand 2. The second extension link or solid spindle 14' engages with a female or internal thread 45 of the displaceable support 4. The handwheel 42 here serves as a rotating device or actuator for the first and second extension links or spindles 13' and 14' which are fixedly connected with each other.

The displacement device 12' shown in FIG. 5, has the advantage that it can be very easily exchanged with another displacement device having shorter or longer extension links or spindles. For this to occur, it is only necessary that the two extension links or spindles 13' and 14' be screwed out of their mating female or internal threads, whereupon, after a corresponding manual displacement of the displaceable support 4, a displacement device 12' with longer or shorter extension links or spindles can be installed.

Furthermore, in FIG. 5 it will be seen that there is established a second or alternate floor reference point, in the form of a second sleeve or insert 21*a*, which is prepared for engaging the displacement device 12'. By means of the first floor reference point or sleeve 21, the first plane 32 is established, for defining the position of the displacement device 12' with the distance or spacing a to the creel middle plane 23; by means of the second spatially fixed floor reference point or sleeve 21*a* a second plane 32*a* is established for defining the position of the displacement device 12' with the distance b to the creel middle plane 23.

If the same winding machine 1*a* with its displacement device 12' is fixed to the second floor reference point or sleeve 21*a*, then it is automatically fixed in relation to a second creel middle plane or center plane 23*a* which maintains the same distance or spacing a from the second plane 32*a*. Thus, the winding machine 1*a* can, according to FIG. 5, be selectively aligned with two different creel middle planes or center planes 23 and 23*a*.

The invention is not limited to the depicted and described exemplary embodiments. In the exemplary embodiment of FIG. 5, there could be provided instead of the handwheel 42, for example, a worm wheel which engages with a worm which can be reversibly driven either left or right-handed, manually or by motor. Such a worm drive would then have a large degree of similarity with the worm drive depicted in FIG. 2.

While there are shown and described present preferred embodiments of the invention, it is to be distinctly understood that the invention is not limited thereto, but may be otherwise variously embodied and practiced within the scope of the following claims. Accordingly,

What I claim is:

1. A winding machine for winding and unwinding a web-like guided material, comprising:

a driven first beam chucking device;

a rotatable second beam chucking device;

a lateral drive frame for carrying said driven first beam chucking device;

an auxiliary side frame;

a longitudinal displaceable support situated between said lateral drive frame and said auxiliary side frame for carrying said second beam chucking device;

the winding machine having a predetermined direction of winding;

a rolling device comprising first and second roller means and enabling the winding machine to move in a direction transverse to said predetermined direction of winding;

said first roller means being operatively associated with said lateral drive frame and said second roller means with said auxiliary side frame;

a displacement device arranged between said auxiliary side frame and said displaceable support and defining a direction of displacement of the winding machine;

said displacement device comprising at least one first extension link connected with said auxiliary side frame and at least one second extension link connected with said displaceable support;

said first and second extension links being positively moveable in opposite directions each by equal amounts relative to a spatially fixed plane passing through said displacement device transversely to said direction of displacement;

the winding machine having a predetermined winding axis;

said first and second extension links each defining respective displacement axes thereof along which said first and second extension links are displaceable;

said displacement axes substantially coinciding with said predetermined winding axis of the winding machine; and said displacement axes of said first and second extension links lying substantially parallel to said predetermined winding axis of the winding machine and passing through a centroid of stress which results from friction reaction forces of said displaceable support and a beam chucking force.

2. The winding machine as defined in claim 1, wherein:

said displacement device includes means for alignment thereof in relation to a spatially fixed floor reference point.

3. The winding machine as defined in claim 1, wherein:

said first and second extension links are constructed as spindles.

4. The winding machine as defined in claim 3, wherein:

said spindles possess threads of the same pitch.

5. The winding machine as defined in claim 3, wherein:

said first extension link possesses a left-hand thread and said second extension link possesses a right-hand thread.

6. A winding machine for winding and unwinding a web-like guided material, comprising:

a driven first beam chucking device;

a rotatable second beam chucking device;

a lateral drive frame for carrying said driven first beam chucking device;

an auxiliary side frame;

a longitudinal displaceable support situated between said lateral drive frame and said auxiliary side frame for carrying said second beam chucking device;

the winding machine having a predetermined direction of winding;

a rolling device comprising first and second roller means and enabling the winding machine to move in a direction transverse to said predetermined direction of winding;

said first roller means being operatively associated with said lateral drive frame and said second roller means with said auxiliary side frame;

a displacement device arranged between said auxiliary side frame and said displaceable support and defining a direction of displacement of the winding machine;

said displacement device comprising at least one first extension link connected with said auxiliary side frame and at least one second extension link connected with said displaceable support;

said first and second extension links being positively moveable in opposite directions each by equal amounts relative to a spatially fixed plane passing through said displacement device transversely to said direction of displacement;

said displacement device including means for alignment thereof in relation to a spatialy fixed floor reference point; and a torque control upright for connecting said displacement device with said spatially fixed floor reference point.

7. A winding machine for winding and unwinding a web-like guided material, comprising:

a driven first beam chucking device;

a rotatable second beam chucking device;

a lateral drive frame for carrying said driven first beam chucking device;

an auxiliary side frame;

a longitudinal displaceable support situated between said lateral drive frame and said auxiliary side frame for carrying said second beam chucking device;

the winding machine having a predetermined direction of winding;

a rolling device comprising first and second roller means and enabling the winding machine to move in a direction transverse to said predetermined direction of winding;

said first roller means being operatively associated with said lateral drive frame and said second roller means with said auxiliary side frame;

a displacement device arranged between said auxiliary side frame and said displaceable support and defining a direction of displacement of the winding machine;

said displacement device comprising at least one first extension link connected with said auxiliary side frame and at least one second extension link connected with said displaceable support;

said first and second extension links being positively moveable in opposite directions each by equal amounts relative to a spatially fixed plane passing through said displacement device transversely to said direction of displacement;

said first and second extension links being constructed as spindles;

said first extension line possessing a left-hand thread and said second extension link possessing a right-hand thread;

said auxiliary side frame having an internal thread;

said displaceable support having an internal thread;

said first and second extension links being fixedly connected with each other;

said first extension link engaging with said internal thread of said auxiliary side frame;

said second extension link engaging with said right-hand thread in said internal thread of said displaceable support; and said displacement device possessing a handwheel actuator for said fixedly interconnected first and second extension links.

8. The winding machine as defined in claim 7, further including:

a rotating actuator;

said rotating actuator comprising a worm wheel fixed to one of said first and second extension links;

said rotating actuator containing a worm; and said worm being reversibly manually operable in left- and right-hand directions.

9. The winding machine as defined in claim 8, further including:

a housing for said worm wheel and said worm;

a torque control support cooperating with said displacement device;

said worm wheel and said worm conjointly defining a worm drive combination;

said worm drive combination being mounted in said housing; and said housing being connectable to a spatially fixed floor reference point by means of said torque control support.

10. The winding machine as defined in claim 9, wherein:

said housing is selectively connectable to at least two floor reference points by means of said torque control support.

11. The winding machine as defined in claim 7, wherein:

a rotating actuator;

said rotating actuator comprising a worm wheel fixed to one of said first and second extension links;

said rotating actuator containing a worm; and said worm being reversibly power-driven in left- and right-hand directions.

12. A winding machine for winding and unwinding a web-like guided material, comprising:

a driven first beam chucking device;

a rotatable second beam chucking device;

a lateral drive frame for carrying said driven first beam chucking device;

an auxiliary side frame;

a longitudinal displaceable support situated between said lateral drive frame and said auxiliary side frame for carrying said second beam chucking device;

the winding machine having a predetermined direction of winding;

a rolling device comprising first and second roller means and enabling the winding machine to move in a direction transverse to said predetermined direction of winding;

said first roller means being operatively associated with said lateral drive frame and said second roller means with said auxiliary side frame;

a displacement device arranged between said auxiliary side frame and said displaceable support and defining a direction of displacement of the winding machine;

said displacement device comprising at least one first extension link connected with said auxiliary side frame and at least one second extension link connected with said displaceable support;

said first and second extension links being positively moveable in opposite directions each by equal amounts relative to a spatially fixed plane passing through said displacement device transversely to said direction of displacement;

said first and second extension links being constructed as spindles;

said first extension link possessing a left-hand thread and said second extension link possessing a right-hand thread;

said displaceable support having an internal thread;

said first extension link is constructed as a hollow spindle with external threads for engaging said internal thread of said auxiliary side frame;

said hollow spindle being provided with an internal thread;

said first extension link having fixedly connected thereto a rotating actuator;

said second extension link being constructed as a non-rotating solid spindle fixedly connected to said displaceable support; and said second extension link engaging with said internal thread of said hollow spindle.

13. The winding machine as defined in claim 12, wherein:

said rotating actuator comprises a worm wheel fixedly connected to said first extension link; and said worm wheel being manually operable in left- and right-hand directions.

14. The winding machine as defined in claim 12, wherein:

said rotating actuator comprises a worm wheel fixedly connected to said first extension link; and said worm wheel being power-driven in left- and right-hand directions.

15. A winding machine for winding and unwinding a web-like guided material, comprising:

a driven first beam chucking device;

a rotatable second beam chucking device;

a lateral drive frame for carrying said driven first beam chucking device;

an auxiliary side frame;

a longitudinal displaceable support situated between said lateral drive frame and said auxiliary side frame for carrying said second beam chucking device;

the winding machine having a predetermined direction of winding;

a rolling device comprising first and second roller means and enabling the winding machine to move in a direction transverse to said predetermined direction of winding;

said first roller means being operatively associated with said lateral drive frame and said second roller means with said auxiliary side frame;

a displacement device arranged between said auxiliary side frame and said displaceable support and defining a direction of displacement of the winding machine;

said displacement device comprising at least one first extension link connected with said auxiliary side frame and at least one second extension link connected with said displaceable support;

said first and second extension links being positively moveable in opposite directions each by equal amounts relative to a spatially fixed plane passing through said displacement device transversely to said direction of displacement;

said first and second extension links being constructed as spindles;

said first extension link possessing a left-hand thread and said second extension link possessing a right-hand thread;

said displaceable support having an internal thread;

said first extension link is constructed as a hollow spindle with external threads for engaging said internal thread of said displaceable support;

said hollow spindle being provided with an internal thread;

said first extension link having fixedly connected thereto a rotating actuator;

said second extension link being constructed as a non-rotating solid spindle fixedly connected with said auxiliary side frame; and said first extension link engaging with said internal thread of said hollow spindle.

* * * * *